United States Patent [19]

Croce, Jr. et al.

[11] Patent Number: 5,076,571

[45] Date of Patent: Dec. 31, 1991

[54] SKATING MOTION SIMULATOR

[76] Inventors: Pasquale W. Croce, Jr., 977 Derring La., Bryn Mawr, Pa. 19101; James McCrossin, 545 Dash St., Media, Pa. 19063

[21] Appl. No.: 571,072

[22] Filed: Aug. 22, 1990

Related U.S. Application Data

[63] Continuation of Ser. No. 145,397, Jan. 19, 1988.

[51] Int. Cl.[5] ..... A63B 23/04

[52] U.S. Cl. ..... 272/70; 272/56.5 SS

[58] Field of Search ..... 272/70, 97, 3, 93, 56.5 SS, 272/56.5, 105, 126, 134; 361/212; 273/3 R, 3 A, 5 R, 5 A; 434/253, 254

[56] References Cited

U.S. PATENT DOCUMENTS 3,908,556 9/1975 Stuhmer ..... 104/134

4,129,916 12/1978 Schlesinger et al. ..... 211/182

4,779,862 10/1988 Keppler ..... 272/70

FOREIGN PATENT DOCUMENTS 2041227 9/1980 United Kingdom ..... 272/1 B

*Primary Examiner*—Stephen R. Crow

*Attorney, Agent, or Firm*—Synnestvedt & Lechner

[57] ABSTRACT

Disclosed is an apparatus for simulating or practicing skating or gliding motion. The disclosed apparatus includes a platform and a low friction layer covering the upper surface of the platform. Also included are end boards continuous with the low friction surface for providing a surface against which the skater may encounter increased resistance to movement. The end boards generally comprises two end boards mounted to the platform and inclined at an angle of between about 45° and about 15° with respect to the platform surface.

13 Claims, 1 Drawing Sheet

SKATING MOTION SIMULATOR

This patent application is a continuation of pending application Ser. No. 145,397, filed Jan. 19, 1988.

BACKGROUND OF THE INVENTION

The present invention relates to an apparatus for use by an athlete or other person for simulating movements required by sporting activities. In particular, the present invention relates to an apparatus for use in simulating or practicing skating or gliding motion.

Professional and amateur athletes, such as hockey players and figure skaters, require frequent and constant practice in order to perfect their athletic ability and to develop the muscles necessary for maintaining top performance. In the case of skaters, skiers and the like, the facilities required for practicing such activities are not always readily available due to climate limitations and/or space restrictions.

Several devices have been developed which are said to allow the practice of a skating or gliding motion without the need for an ice or snow packed surface as is normally required. For example, U.S. Pat. No. 3,497,211-Nagin discloses a gliding surface formed of a selected thermosetting or thermoplastic resin with either a glossy smooth surface or with irregularities. The invention disclosed by the Nagin reference requires a skate, ski or other gliding element comprised of a resin having a very low coefficient of friction, but also having associated therewith a friction surface that may be selectively utilized to provide forward thrust, breaking or guiding qualities when required. The device also requires a large area and complex and burdensome installation procedures. For example, a shallow excavation must be made in an available outside area then a concrete curb is formed around the excavated area. The excavation must normally be at or below the level of the normal frost line. The gliding surface requires several panels, each four to eight feet wide. Moreover, the surface contains no means for assuring that the skaters motion is anatomically correct. Other patents which disclose the use of low friction plastic materials in conjunction with artificial skating surfaces include U.S. Pat. Nos. 3,508,945-Haemer and 4,438,003-Nathaniel et al.

SUMMARY OF THE INVENTION

It is one object of the present invention to provide a low cost apparatus for practicing skating or gliding movements.

It is a further object of the present invention to provide an apparatus which allows skaters, skiers and the like to practice gliding movements which are anatomically similar to actual skating or skiing movements.

It is a still further object of the present invention to provide a skating motion simulating apparatus which requires an area much smaller than that normally required.

These and other objects of the present invention are provided by an apparatus which includes a platform and a low friction layer covering the upper surface of the platform. Also included are push off means continuous with said low friction surface for providing a surface against which the skater may encounter increased resistance to movement. The push-off means generally comprises two end boards mounted to said platform and inclined at an angle of between about 45° and about 15° with respect to the platform surface.

DETAILED DESCRIPTION

Figure 1:
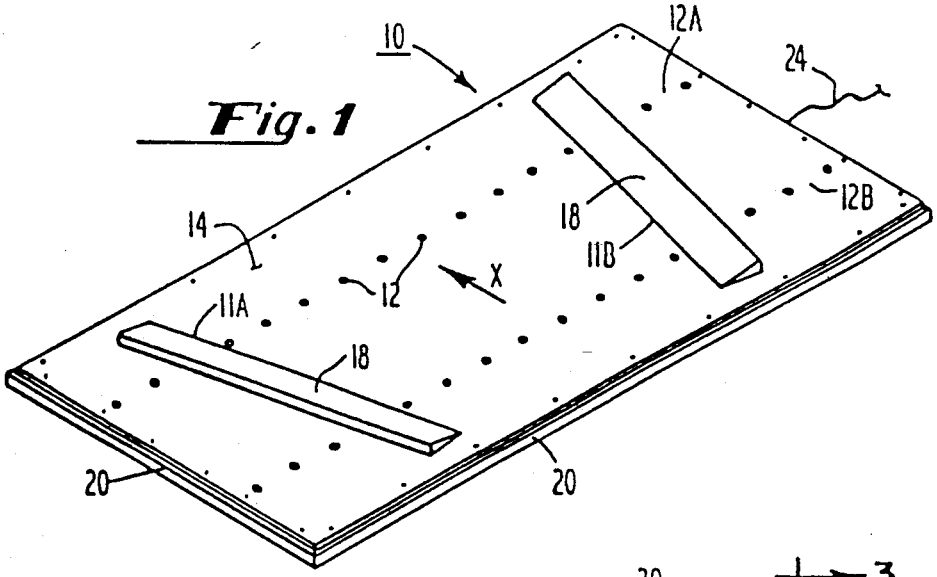
FIG. 1 is a top perspective view of one apparatus according to the present invention.

With particular reference to the embodiment shown in FIG. 1, the present invention includes a rectangular flat platform 10. Although it will be clear to those skilled in the art that the length and width of platform 10 may be varied within the scope of the present invention, platform 10 preferably has a length or longitudinal dimension of about 100 inches or about eight feet and a width or lateral dimension of preferably about 50 inches or about four feet. Applicant has found that the preferred dimensions of platform 10 produce an apparatus which is easily located in most gymnasiums or other indoor training facilities while at the same time providing a surface with sufficient area to accomplish anatomically correct simulation of the skating motion. In order to perfect skating movements and fully develop the muscles generally required for the skating motion, it has heretofore been necessary for the skater to utilize the services and facilities of a full size skating rink. Very frequently, however, such facilities are not readily available. According to the present invention, an athlete may achieve anatomically proper practice of his skating motion in an area much smaller than is otherwise normally required.

The upper surface of platform 10 is generally flat and is covered by a sheet or layer 14 of low friction material. According to one preferred embodiment of the present invention, sheet 14 comprises a ⅜ inch thick sheet of high molecular weight polyethylene film. One such material is sold under the trade name "SOLIDUR UHMW" by the Solidur Plastics Co. of Pittsburgh, Pa.

Mounted to the upper surface of platform 10 are push-off means for providing an inclined surface against which the skater using the device of the present invention may encounter increased resistance to movement. According to a preferred embodiment, such push-off means comprise end boards 11A and 11B. For the purposes of clarity and illustration, the term "inclined surface" as used herein refers to a surface which rises off the generally planar upper surface of platform ten. It is contemplated that in most embodiments of the present invention the generally planar upper surface of platform 10 will lie in a substantially horizontal plane. In such embodiments, therefore, the inclined surface will be inclined with respect to horizontal.

Each end board 11A and 11B has a pair of dowels 17 contained in or otherwise mounted to its underside. Dowels 17 are spaced to engage rows 12A and 12B of apertures 12. Dowels 17 are sized such that the portions thereof protruding from the underside of end boards 11A and 11B fit snugly but removably into aperture 12. The end boards are thus adjustably mounted to platform 10 and may be placed in a plurality of positions along the length thereof. In this way, the position of end boards 11A and 11B may be adjusted according to the size and preference of the particular athlete using the apparatus.

In operation, the skater simulates and/or practice the natural skating movement by standing on platform 10 facing in the direction generally designated by x in FIG. 1. As used herein, the term "skater" refers to an athlete or any other person using the apparatus of the present invention to simulate or practice skating or skating movements. As used herein, the terms "skating" and "skating movements" refer to movements of the type normally utilized by ice skaters, roller skaters and the like. In addition. for the purpose of convenience, the direction x is also sometimes referred to herein as the direction of use. Simulation of skating movements according to the present invention is generally practiced with the skater wearing boots or shoes having a low friction lower surface. According to one preferred embodiment, the skater wears boots or boot like coverings having lower surfaces comprised of a low friction material similar to surface 14 of platform 10. In this way the skater "glides" over the upper surface 14 of the platform 10 in a manner which simulates the normal gliding portion of natural skating. In operation, the "power strike" of the skating movement is simulated when the skaters shoe or boot comes in contact with the inclined surface provided by end boards 11A or 11B. The inclined surface 18 of end boards 11A and 11B provides, in part, a source of resistance to the movement of the skaters boots or shoe. According to one preferred embodiment, end boards 11A and 11B have an upper surface 18 comprised of a wooden substance which provides an additional source of resistance due to its relatively rough surface.

In addition to the increase in resistance described above, the inclined surface 18 of end boards 11A and 11B provides means for simulating the anatomical position of the lower portion of the skaters body during the "power stroke" of the skating motion. Applicant has found that although the angle of inclination of surface 18 may be varied, it is preferred that surface 18 forms an angle of between about 15° and about 45° with respect to the flat upper surface 14 of platform 10, and even more preferably an angle of about 15°. The present invention thus not only helps to develop the particular muscles used in the skating motion, it also helps the skater to practice anatomically correct lower body motion. The transition from the flat upper surface 14 of platform 10 to the inclined surface 18 is preferably substantially continuous in order to simulate a smooth power stroke. In this way the skaters boot or shoe glides easily in a direction substantially perpendicular to the direction generally indicated by X in FIG. 1. The skaters boot moves relatively easily and smoothly over layer 14 until it reaches the inclined surface 18 of end boards 11A or 11B where it encounters increased resistance to gliding. The skater then simulates the power stroke by "pushing off" the end board 11A or 11B, thus causing the other foot to glide easily over to the other end board. This motion may be repeated for as long a period as desired by the skater or as dictated by the skaters trainer, thus developing the muscles used in the natural skating motion and affording the skater the opportunity to practice his or her skating technique in a relatively small and confined area.

End boards 11A and 11B may be oriented with respect to the direction of use x in FIG. 1 in any manner which provides a suitable push-off surface as described above. Although it is contemplated, for example, that the end boards 11A and 11B may be orientated so as to provide a push off surface which is substantially parallel to the direction x, the push-off boards are preferably orientated in a non-parallel manner with respect to direction x, as shown in FIG. 1. As the term is used herein, the orientation of the end boards refers to the relative position of the leading edge of the push-off surface with respect to the direction in which the user is expected to stand when using the apparatus. As the term is used herein, the leading edge of a push-off surface refers to the edge of the push-off surface adjacent to the upper surface of platform 10. In an even more preferred embodiment, the end boards are orientated so as to diverge from one another in the direction of x. Put another way, the end boards are preferably angled so as to open in the direction in which the user is expected to stand. Applicant has found that angeling the end boards in this manner enhances and augments the anatomical simulation provided by the apparatus. According to a preferred embodiment of the present invention, the end boards are angled so as to open at an angle of approximately 15° with respect to direction x, that is, the line representing the leading edge of the end boards intersects the line representing direction x at an angle of 15° at a point behind the user. As will be understood by those skilled in the art, the direction x is generally parallel to the lateral edges of the apparatus. Thus it is contemplated that the orientation and angles referred to above may also usually be measured with respect to the lateral edges of the apparatus. For example, in the preferred embodiment the line representing the leading edge of the left end board intersects the line representing the left lateral edge of the apparatus at an angle of about 15° at a point in front of the user. Similarly, in the preferred embodiment the line representing the leading edge of the right end board intersects the line representing the right lateral edge of the apparatus at an angle of about 15° at a point in front of the user. An alternative way to describe the orientation of the end boards in the preferred embodiment is to note that the lines representing the leading edges of the end boards intersect at point behind the user and the angle between the lines is 30°.

Figure 2:
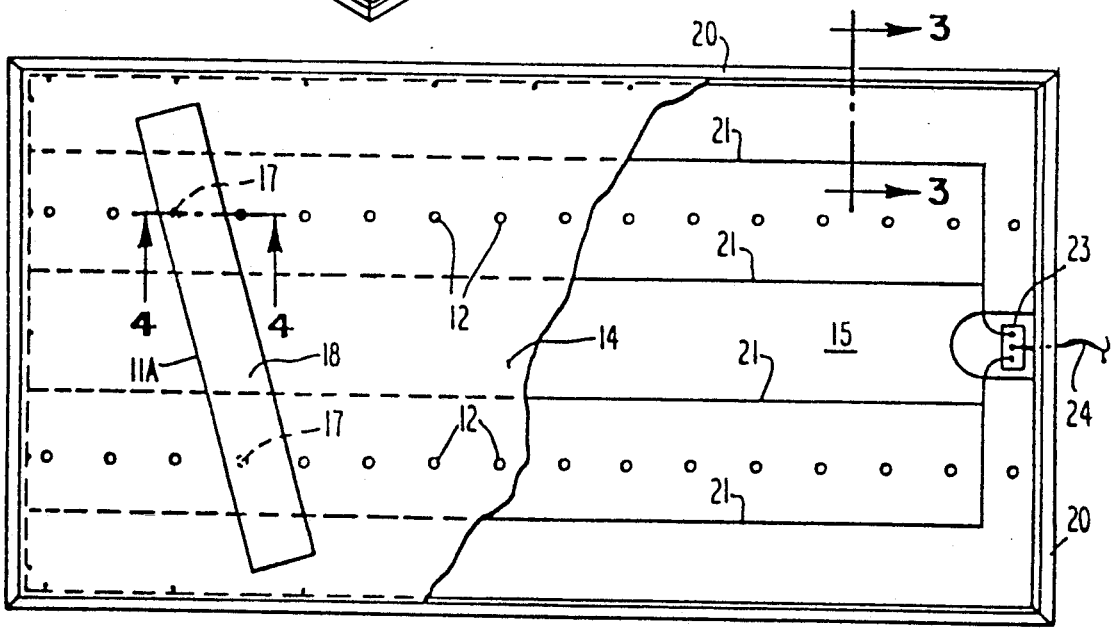
FIG. 2 is a partially cut away plan view of the apparatus shown in FIG. 1.
Figure 3:
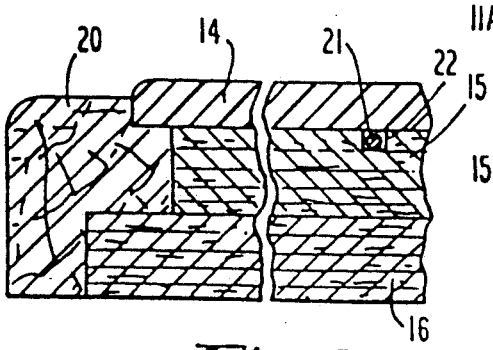
FIG. 3 is a cross sectional view taken substantially along lines 3—3 of FIG. 2.
Figure 4:
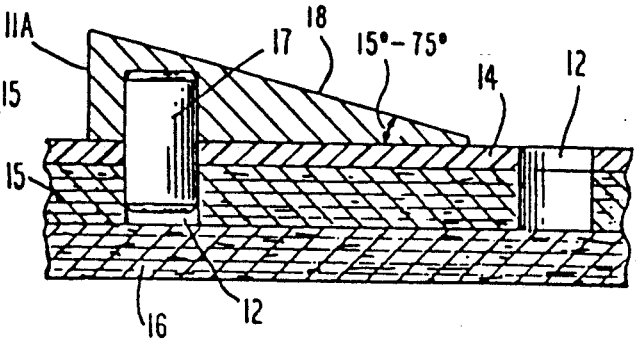
FIG. 4 is a cross sectional view taken substantially along lines 4—4 of FIG. 2.

The preferred construction of platform 10, as best revealed in FIGS. 2–4, provides a firm, stable surface for simulation of the skating motion. Sheet 14 comprises a low friction material which is adhered or otherwise mounted to upper plywood sheet 15. According to one preferred embodiment sheet 15 is a ¾" thick sheet of plywood approximately four feet wide and eight feet long. Sheet 15 is in turn mounted to a second plywood sheet 16 of substantially the same dimensions. The platform is bordered by border portions 20 comprised of strips of red oak.

Accordingly to a preferred embodiment of the present invention, platform 10 also includes grounding means for dissipating the build up of static electricity which may result from the use of the apparatus. The dissipating means according to the preferred embodiment of the present invention will now be described with particular reference to FIGS. 2 and 3. Upper sheet 15 includes a plurality of grooves 22 running along the length of platform 10. Grounding wires 21 are contained within grooves 22. It is preferred that the radius of the grounding wire is about equal to or slightly less than the depth of groove 22 such that the grounding wires are in contact with the lower surface of low friction sheet 14. Grounding wires 21 are collected at one end of platform 10 where they are conductively joined to a grounding block 23. A grounding harness 24 is in turn conductively connected to grounding block 23. In operation, grounding harness 24 is securely fastened to a convenient source of ground. In this way, any static electricity which is accumulated on the upper surface of platform 10 during the use thereof is dissipated through conductors 21 to grounding block 23 and to ground via grounding harness 24. Provision of a dissipating means in the apparatus of the present invention eliminates the annoying and disadvantageous build up of static electricity which is otherwise associated with skating motion simulators.

As will be appreciated by those skilled in the art, the above descriptions are illustrative of the present invention but not limiting thereof, it being possible to make changes in the embodiments described above without departing from the scope of the present invention.

What is claimed is:

1. An apparatus adapted for use by a skater for simulating and practicing skating comprising:

(a) a platform comprising a substantially flat upper surface, said platform having a longitudinal dimension and a lateral dimension;

(b) a low friction sheet covering the upper surface of said platform;

(c) two spaced push-off means for providing an inclined surface against which the skater encounters increased resistance to movement, said push-off means being inclined at an angle of between 15° and about 45° with respect to the upper surface of said platform; and (d) means for adjustably mounting at least one of said push-off means to said platform, said mounting means comprising means for releasably connecting said push-off means to said platform such that the spacing between said push-off means is adjustable.

2. The apparatus of claim 1 wherein said push-off surfaces are each inclined at an angle of about 15° with respect to the upper surface of said platform.

3. The apparatus of claim 1 wherein said low friction sheet comprises a low friction sheet of high molecular weight polyethylene film.

4. The apparatus of claim 3 wherein said platform further includes means for dissipating the build up of static electricity from said sheet of polyethylene film.

5. The apparatus of claim 4 wherein said means for dissipating includes a grounded conductor in contact with said sheet of polyethylene film.

6. An apparatus adapted for use by a skater in a predetermined direction of use for simulation of skating motion comprising:

(a) a platform comprising a substantially flat upper surface, said platform having a longitudinal dimension and a lateral dimension;

(b) a low friction sheet covering the upper surface of said platform;

(c) two spaced push-off means for providing a pair of opposed inclined push-off surfaces against which the skater encounters increased resistance to movement, at least one of said inclined push-off surfaces being oriented at an angle of from about 15° to about 45° with respect to the upper surface of said platform; and (d) means for mounting said push-off means to said platform, said mounting means comprising means for releasably connecting at least one of said push-off means to said platform.

7. The apparatus of claim 6 wherein said low friction sheet comprises a low friction sheet of high molecular weight polyethylene film.

8. The apparatus of claim 6 wherein said push-off surfaces are each inclined at an angle of about 15° with respect to the upper surface of said platform.

9. The apparatus of claim 6 wherein said mounting means comprise means for adjustably mounting at least one of said push-off means such that the spacing between said push-off means is adjustable.

10. The apparatus of claim 6 wherein said mounting means comprises means for mounting said push-off means so as to be not substantially parallel to one another.

11. The apparatus of claim 6 wherein said mounting means comprises means for mounting at least one of said push-off means such that said push-off means are oriented so as to diverge from one another in the direction of use.

12. The apparatus of claim 6 wherein said mounting means comprises means for mounting at least one of said push-off means so as to be oriented at an angle of about 15° with respect to the direction of use.

13. The apparatus of claim 6 wherein said push-off means comprise generally the rectangular members having an inclined surface thereon, said members being not substantially parallel to the direction of use.

* * * * *